US009901967B2

(12) United States Patent
Magnani

(10) Patent No.: US 9,901,967 B2
(45) Date of Patent: Feb. 27, 2018

(54) ROLL LEVELLER FOR METAL SHEETS AND A PROCESS FOR LEVELLING A METAL SHEET WITH IT

(71) Applicant: F.I.M.I.-FABBRICA IMPIANTI MACCHINE INDUSTRIALI-S.P.A., Vigano' (lc) (IT)

(72) Inventor: Giulio Magnani, Lecco (IT)

(73) Assignee: F.I.M.I.—FABBRICA IMPIANTI MACCHINE INDUSTRIALI—S.P.A., Vigano' (LC) (IT)

( * ) Notice: Subject to any disclaimer, the term of this patent is extended or adjusted under 35 U.S.C. 154(b) by 0 days.

(21) Appl. No.: 14/767,752

(22) PCT Filed: Feb. 18, 2014

(86) PCT No.: PCT/IB2014/059074
§ 371 (c)(1),
(2) Date: Aug. 13, 2015

(87) PCT Pub. No.: WO2014/128614
PCT Pub. Date: Aug. 28, 2014

(65) Prior Publication Data

US 2016/0001339 A1 Jan. 7, 2016

(30) Foreign Application Priority Data

Feb. 19, 2013 (IT) ..... MI2013A0229

(51) Int. Cl.
*B21D 1/02* (2006.01)

(52) U.S. Cl.
CPC ..... *B21D 1/02* (2013.01)

(58) Field of Classification Search
CPC ..... B21D 1/02; B21D 3/02
See application file for complete search history.

(56) References Cited

U.S. PATENT DOCUMENTS 3,867,826 A 2/1975 Noe
4,204,413 A 5/1980 Miller
(Continued)

FOREIGN PATENT DOCUMENTS

DE 3720208 12/1988
DE 3824372 1/1990
(Continued)

OTHER PUBLICATIONS

International Search Report issued in PCT Application No. PCT/IB2014/059074.

*Primary Examiner* — Teresa M Ekiert
(74) *Attorney, Agent, or Firm* — Lucas & Mercanti, LLP

(57) ABSTRACT

A roll leveler for metal sheets, comprising a plurality of leveling rolls (R1-R21), a plurality of adapter shafts, a plurality of torque limiters. Each adapter shaft is arranged for actuating at least one of the leveling rolls (R1-R21) and drives or is driven by one of the torque limiters. Each of the torque limiters is arranged for limiting, to a predetermined limit torque, the maximum driving torque that the relative adapter shaft can transmit to a relative leveling roll (R1-R21), driving it, and is provided with a torque regulator arranged for varying the predetermined limit torque also when the leveler is leveling the metal sheet to be processed (L). Each of the torque limiters, or in any case, each adapter shaft is arranged for actuating the relative leveling roll (R1-R21) also after reaching the predetermined limit torque.

16 Claims, 8 Drawing Sheets

(56) References Cited

U.S. PATENT DOCUMENTS

| | | | |
|---|---|---|---|
| 5,688,176 | A | 11/1997 | Heidenreich et al. |
| 2008/0307912 | A1 | 12/2008 | Schafer |

FOREIGN PATENT DOCUMENTS

| | | | |
|---|---|---|---|
| DE | 3501871 | | 5/1994 |
| EP | 0060965 | | 9/1982 |
| EP | 0142577 | | 5/1985 |
| JP | S59054420 | A | 3/1984 |
| JP | S59225823 | A | 12/1984 |
| SE | 445979 | B | 8/1986 |
| WO | 8907992 | | 9/1989 |

ROLL LEVELLER FOR METAL SHEETS AND A PROCESS FOR LEVELLING A METAL SHEET WITH IT

CROSS-REFERENCE TO RELATED APPLICATIONS

This application is a 371 of PCT/IB2014/059074, filed Feb. 18, 2014, which claims the benefit of Italian Patent Application No. MI2013A000229, filed Feb. 19, 2013.

FIELD OF THE INVENTION

The present invention concerns a roll leveler for metal sheets. More in particular the invention concerns a leveler that is provided with torque limiters for limiting and/or regulating the torque that drives its leveling rolls.

The present international patent application claims the priority of Italian patent application num. MI2013A000229 and incorporates the content thereof through reference.

STATE OF THE ART

It is currently known to use roll levelers to increase the flatness of metal sheets and to reduce the inner tensions thereof.

Such machines are provided with two levels of parallel and offset leveling rolls, so as to press and guide the metal sheet in an undulating route so as to cause, through alternate bending, the yielding in a raised portion of its thickness.

In such a way the metal sheet is leveled through plasticization, and shape irregularities and internal tension possibly present are reduced. Examples of known roll levelers are described in publications EP60965, WO 89/07992 and IT1355222, the latter corresponding to Italian patent application n° MI2004A479.

In known levelers the leveling rolls are usually actuated through a distributing/reducing group that shares out the mechanical power supplied by a motor to many adapter shafts; each adapter shaft drives a leveling roll. The distributing/reducing group usually comprises one or a plurality of toothed drive wheels that engage and actuate planetary toothed wheels. These planetary toothed wheels actuate the adapter shafts through a second stage of further planetary toothed wheels.

In some known levelers, the adapter shafts actuate the leveling rolls through pins which break when operating beyond a certain resistant torque limit, preventing damage from overloading of the drive elements, or of the leveling rolls. In this last type of levelers, after a limited operation time, the leveling rolls have faceted surfaces caused by twisting vibrations generated by the contrast between the rigidity of the mechanical coupling upstream of the actuations rolls, and in particular in the distributing/reducing group, and the forces exchanged between rolls and metal sheet to be processed.

Indeed, on one hand the mechanical transmission upstream of the rolls, to which the distributing/reducing group and the adapter shafts belong, tends to make the various leveling rolls rotate at the same speed, whereas on the other hand the different curvatures given to the metal sheet during the processing tend to make each leveling roll rotate at its own speed which is different from that of the other rolls.

On the other hand, the purely mechanical transmission and distribution system described above for the movement upstream of the leveling rolls, is more suitable for transmitting great actuation torque in relatively small spaces, such as the volume of space occupied by the group of leveling rolls, with respect for example to hydraulic transmission systems. This advantage can be particularly appreciated when leveling highly resistant steel metal sheets, in which it is necessary to have leveling rolls with a small diameter and that are closer together.

In order to reduce the major drawbacks caused by machine idle time due to breaking of the pins, patent IT1355222 describes a roll leveler in which the pin connections are replaced by torque limiters with friction disks that limit the maximum torque that the adapter shafts can transmit to the leveling rolls. This type of torque limiter, despite being very small, is capable of transmitting torque that is very high. The maximum transmissible torque can be regulated by acting on the threaded dowels that vary the preload of the Belleville springs, which in turn press the friction disks against each other.

However, in order to regulate the threaded dowels it is necessary to stop such a leveler and demount the adapter shafts so as to be able to reach the inside of the disk torque limiters. This clearly leads to undesired and unproductive machine idle time.

Therefore, one purpose of the present invention is to provide a leveler or a leveling process in which it is possible to regulate the maximum torque that the leveling rolls can apply to the metal sheet to be processed faster and more easily, with respect to known levelers.

SUMMARY OF THE INVENTION

Such a purpose is achieved, in a first aspect of the present invention, with a roll leveler having the characteristics according to claim 1.

In a particular embodiment, the leveler comprises a number of leveling rolls (R1-R21) that is comprised between 1 and 23.

In a second aspect of the invention, such a purpose is achieved with a process for leveling a metal sheet with a roll leveler, comprising the following operations:

a) providing a roll leveler having the characteristics according to one of the previous claims, and moreover comprising:

a mechanical power take-off like for example a driving shaft;

a distributing/reducing group;

b) making a metal sheet to be processed pass between the two layers of leveling rolls imposing an undulating route on the metal sheet to be processed;

c) actuating the distributing/reducing group by means of the mechanical power take-off, so that the latter drives the adapter shafts and distributes between them, the mechanical power, supplied by the mechanical power take-off and each adapter shaft drives at least one of the leveling rolls;

d) limiting to a predetermined limit torque by means of the relative torque limiter, the maximum driving torque that can be transmitted by each of the adapter shaft, so that during the leveling of a metal sheet, the limit torque of at least one of the leveling rolls upstream is substantially lower than the maximum driving torque that the adapter shaft of the at least one leveling roll upstream can transmit in the absence of the relative torque limiter.

In a particular embodiment, the process according to the invention comprises the operation of calibrating or regulating the predetermined limit torque of each of the torque limiters so that during the leveling of a metal sheet, each of the torque limiters constantly and regularly transmits a torque equal to the relative predetermined limit torque and, for example, the friction disks constantly slide with respect to one another.

In a particular embodiment, the process according to the invention comprises the operation of calibrating or regulating the predetermined limit torque of at least one torque limiter so that it is equal to or lower than 1.5 times the minimum operating torque, with null deformation, i.e. the minimum torque that the limiter in question should transmit in order to make the relative leveling roll rotate, if the deformation work produced by that roll on the metal sheet to be processed, is null.

In a particular embodiment, the process according to the invention comprises the operation of calibrating or regulating the predetermined limit torque of at least one torque limiter which drives a leveling roll upstream so as to keep it equal to or lower than 0.3 times the average torque of the various torque limiters.

The advantages that can be achieved with the present invention shall become clearer, to a man skilled in the art, from the following detailed description of some particular non limiting embodiments, which are illustrated with reference to the following schematic figures.

LIST OF THE FIGURES

DETAILED DESCRIPTION

Figure 1:
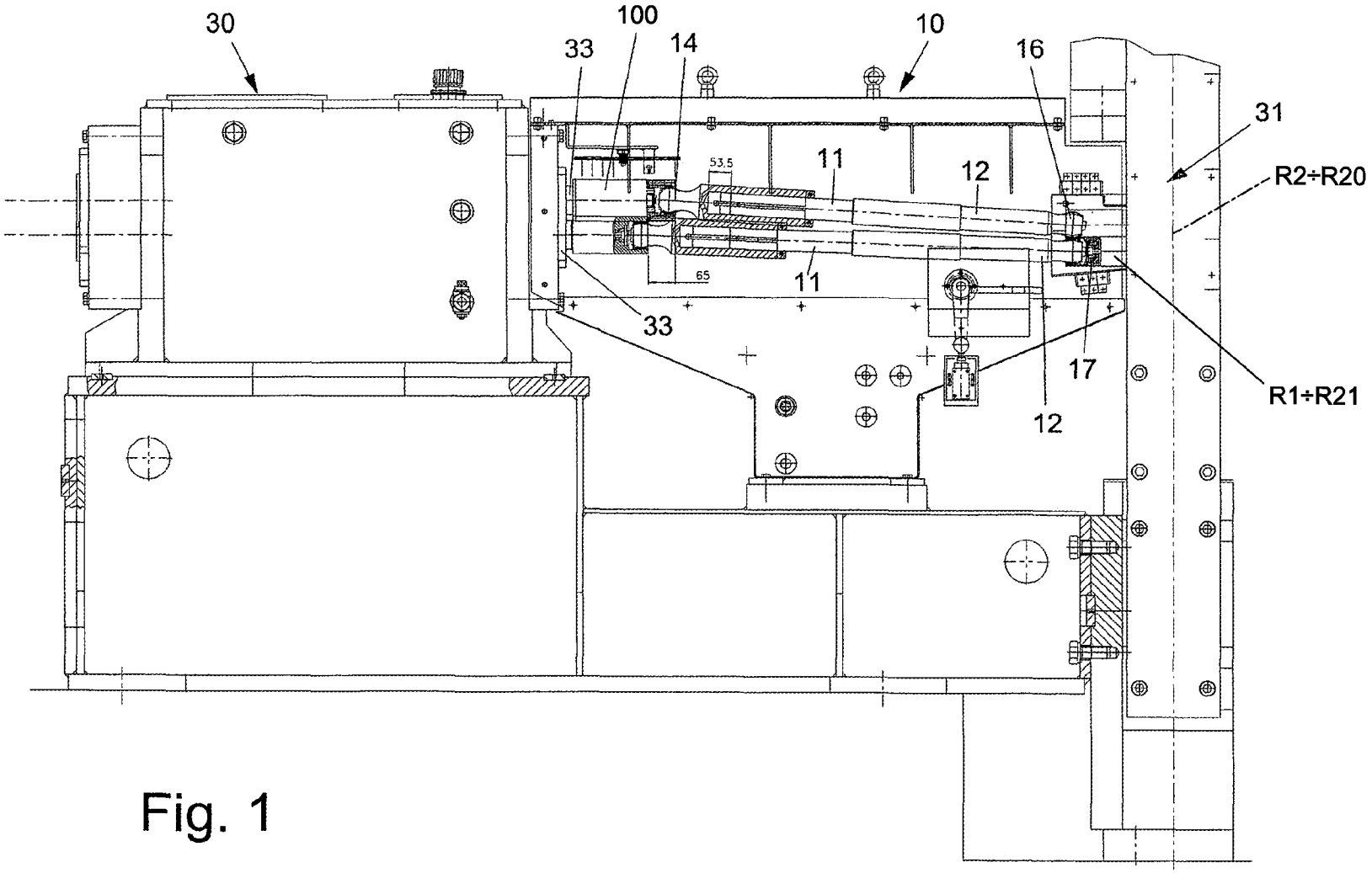
FIG. 1 shows a side view of the transmission and distribution system of a leveler that can be used for actuating a leveling process according to a first particular embodiment of the invention.
Figure 2:
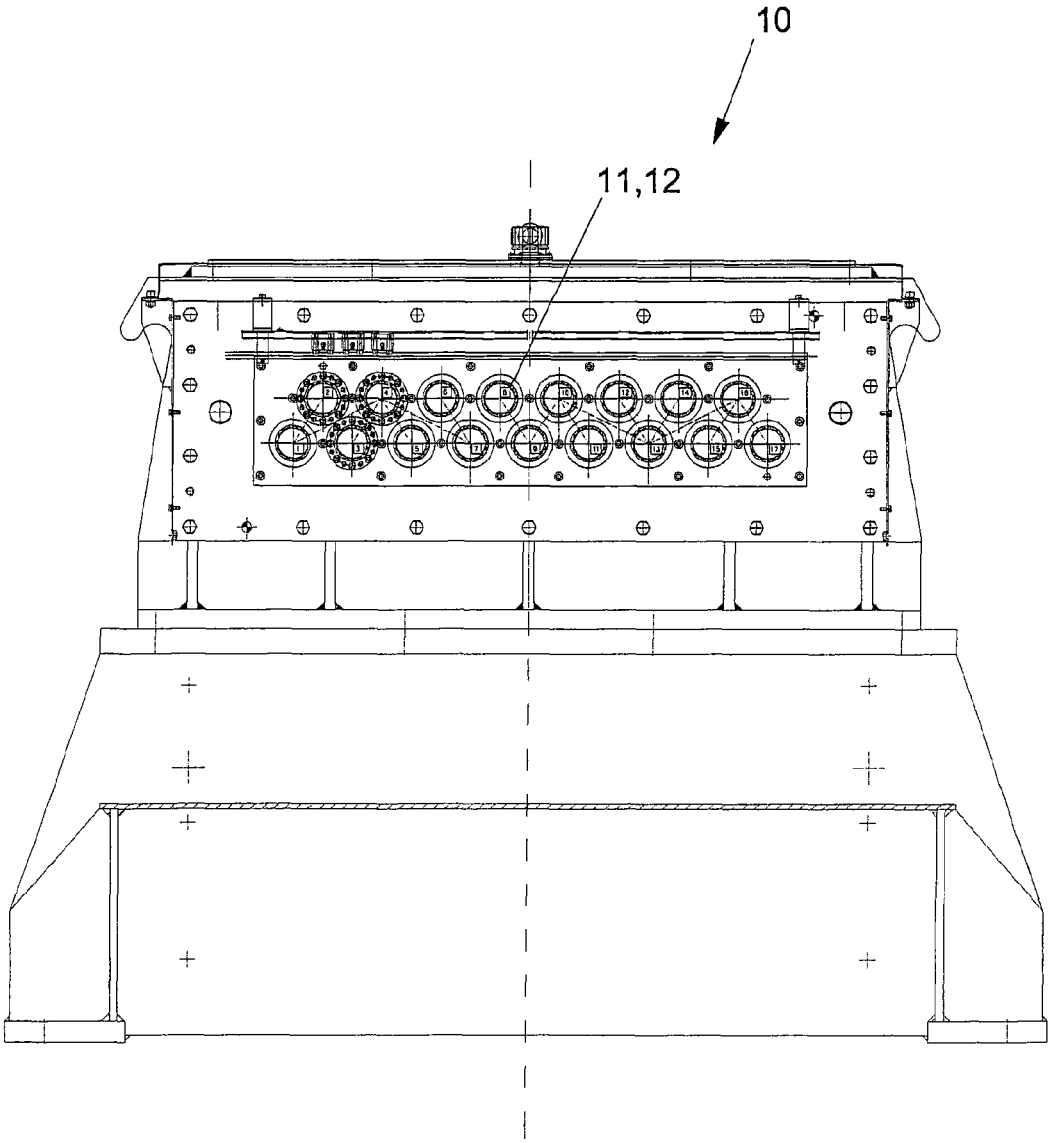
FIG. 2 shows a front view of the transmission and distribution system of FIG. 1.

In the present description, by "calibration torque" we mean the maximum torque that can be transmitted by a torque limiter 40 that is measured directly at the ends of the two drive shafts, upstream and downstream, coming out from the limiter itself, whereas by limit torque we mean the torque with which a leveling roll is driven, measured on the roll itself, when the torque transmitted by the relative torque limiter 40 is equal to its calibration torque.

FIGS. 1-4 refer to a leveler according to a first particular embodiment of the invention, wholly indicated with reference numeral 31 and that can be used to actuate the process according to the invention by leveling metal sheets, for example in the form of sheets or bands.

Figure 4:
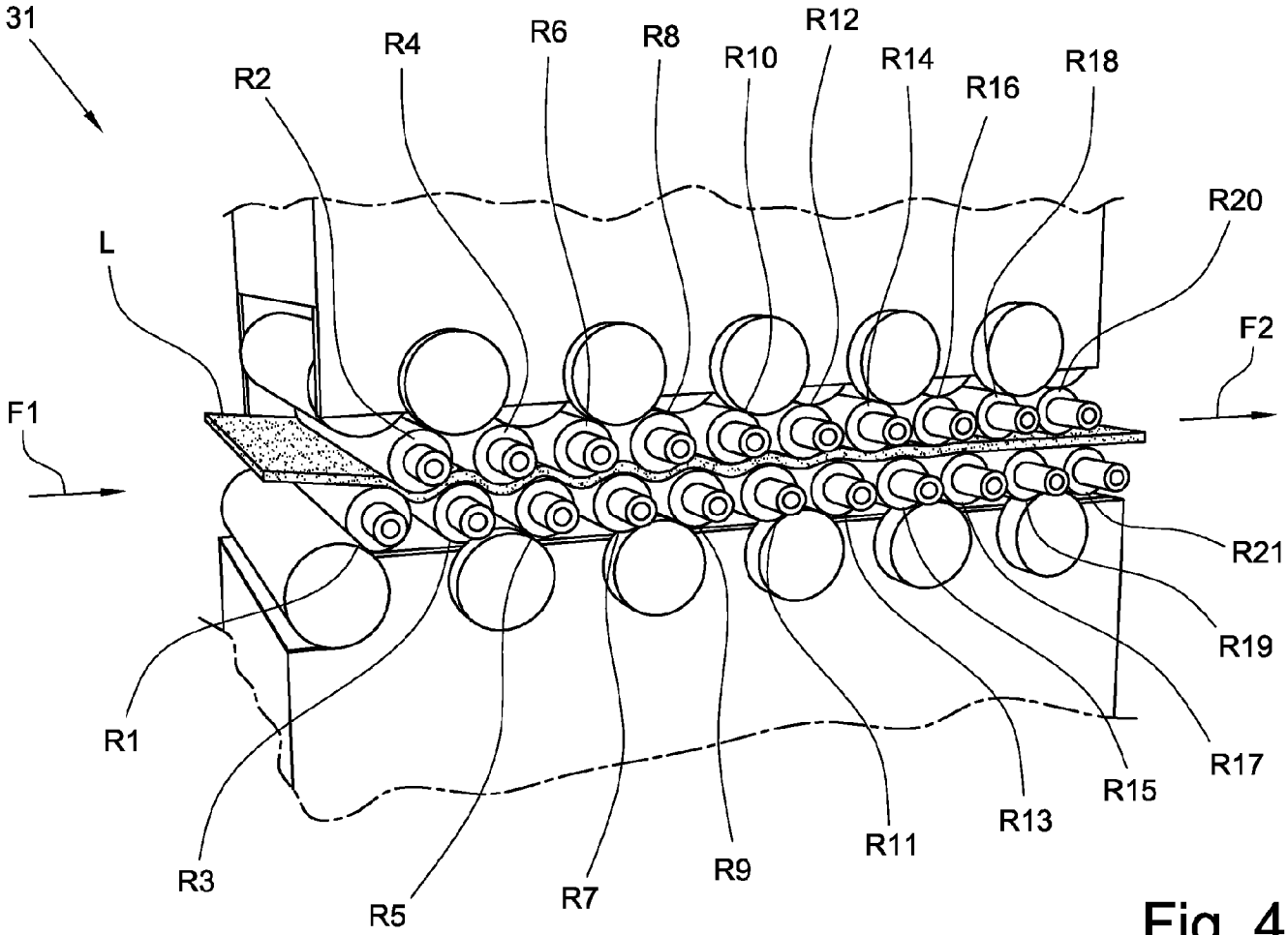
FIG. 4 shows a perspective view of the leveling rolls of the leveler of FIG. 1.

The leveler 31 is preferably of the multi-roll type. The leveling rolls R1-R21 are parallel and offset, i.e. arranged staggered or in any case in a way such as to not vertically juxtapose their axes so as to allow a metal sheet to be processed L to pass between the two layers of leveling rolls R1-R21 themselves following an undulating route, the latter being shown as an example in FIG. 4. The undulating route of the metal sheet, consists of a series serpentine folds in the metal sheet, alternating upwards and downwards with reference to the advancing direction of the metal sheet itself; the arrows F1 and F2 indicate the sliding direction of the metal sheet to be processed L entering and coming out from the leveler 31 (FIG. 4).

The leveling rolls R1-R21 are actuated by a transmission and distribution system 10 which can be driven by a distributing/reducing group 30 of the known type and which preferably comprises a plurality of adapter shafts.

The distributing/reducing group 30 is driven by a suitable mechanical power take-off, such as for example the outlet shaft of a motor for example of the hydraulic or electric type, and can comprise for example one, two or many toothed drive wheels which engage with planetary toothed wheels actuating them. These first planetary toothed wheels can drive the adapter shafts directly or for example by means of a second stage of further planetary toothed wheels.

The transmission and distribution system 10 transmits, therefore, the driving torque coming from the distributing/reducing group 30 to the rolls R1-R21 of the leveler 31.

Every adapter shaft preferably comprises two telescopic portions, a first portion 11 and a second portion 12.

Preferably the first portion 11 has the end facing the distributing/reducing group that is provided with a coupling head 14 ending in a spherical end that is provided with toothing 18 so as to receive the torque transmitted at different inclinations.

This last provision together with the telescopic ability is useful for example for demounting and replacing the adapter shafts 11, 12.

Similarly, also the second portion 12 of adapter shaft is preferably provided with a head 16, which in turn has toothing for the engagement of a coupling 17 similarly toothed and fixed to the head of the corresponding roll R1-R21.

Figure 3:
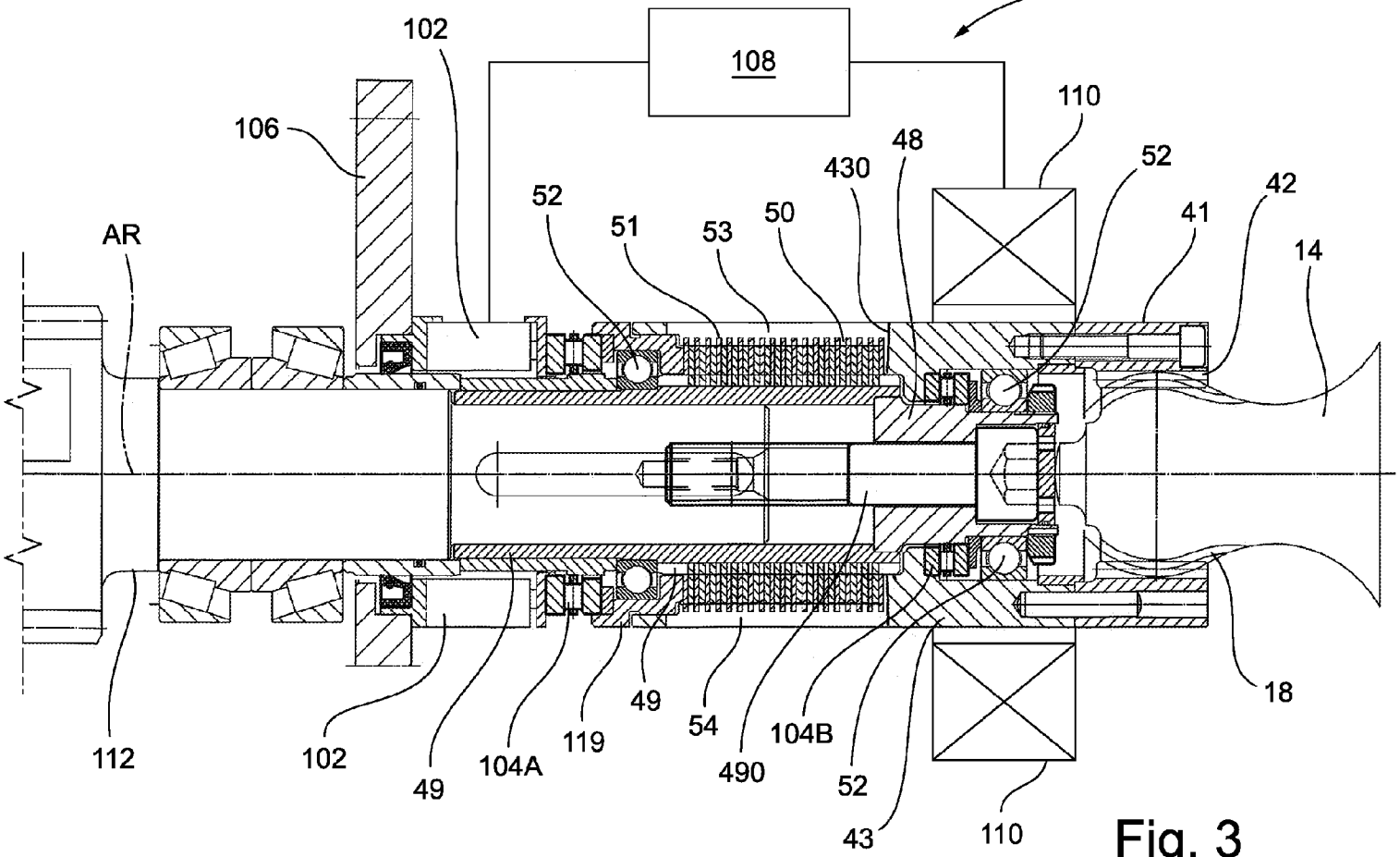
FIG. 3 shows a side view, partially in section, of a torque limiter of the transmission and distribution system of FIG. 1.

FIG. 3 shows an example of a torque regulator 100, according to a first embodiment of the invention, of which the leveler 31 is preferably provided for transmitting the torque from the distributing/reducing group to each first portion 11 of adapter shaft until a predetermined and precalibrated value has been reached. Preferably, the torque regulator 100 comprises a torque limiter 40 which transmits the driving torque to the rolls R1-R21 by means of a friction system comprising friction disks 50, 51 lying on normal planes with respect to the rotation axis AR of the adapter shaft to which the limiter 40' is fixed.

Preferably, the torque limiter comprises an external sleeve 43 having the function of a casing, at one end of which a ring 41 is mounted fixed through screws 44.

The ring 41 is provided with toothing 42 that is suitable for engaging the corresponding toothing 18 arranged on the head 14 of the first portion of adapter shaft 11.

Inside the external sleeve 43 and coaxially with it a splined shaft 49 is preferably housed carrying the driving friction disks 50 that are mounted at intervals with driven disks 51 and that are suitable for contacting them so as to exert the necessary friction.

The friction disks 51 are on the other hand mounted, so as to be able to slide axially, in a grooved seat formed inside the external casing 43. For example on the external casing 43 a suitable annular shoulder 430 is obtained against which the disks 50, 51 can be axially pushed.

The splined shaft 49 is integrally fixed to the shaft 112 that drives one from the leveling rolls R1-R21, for example by means of the annular cap 48 and the screw 490, and is preferably supported in rotation with respect to the external sleeve 43 through bearings 52 and has the end coming out from the limiter that is fixed to a drive hub 33 that is suitable for receiving the movement from the motorization and transmission system 30. The axial thrust of the actuator 102, described in the rest of the description, is preferably applied to the friction disks 50, 51 through:

- the thrust bearing 104A, which is mounted on the external sleeve 43 and axially integral with it;
- the spacer 119, which can axially slide with respect to the splined shafts 43 and 49; and
- the thrust bearing 104B, which is mounted on the annular cap 48 or that in any case is integral with the splined shaft 49, and is axially integral with the shaft itself. The two thrust bearings 104A, 104B together with the two radial bearings 52, on one hand, make the rotations of the external sleeve 43 and of the coupling head 14 independent from one another, and on the other hand make it possible to mount the hydraulic cylinder of the actuator 102 on the load-bearing frame 106 of the leveler 31.

According to one aspect of the invention, each of the torque limiters 40 is arranged for limiting, to a predetermined limit torque, the maximum driving torque that each adapter shaft 11, 12 can transmit to a relative leveling roll R1-R21, driving it, and is provided with a torque regulator 100 arranged to vary the predetermined limit torque also while the leveler 31 is leveling the metal sheet to be processed L.

As shall become clearer from the rest of the description, each of the torque limiters 40, or in any case each adapter shaft 11, 12 is arranged for continuing to drive the relative leveling roll R1-R21 also after the predetermined limit torque has been reached.

Preferably each of the torque limiters is in turn provided with an actuator 102 that is arranged for varying the predetermined limit torque also while the leveler 31 is leveling the metal sheet to be processed L.

Preferably, the actuator 102 is arranged for pressing the friction disks 50, 51 against each other with a variable pressure, at least according to a direction that is parallel to the predetermined rotation axis of the plurality of friction disks themselves.

The actuator 102 preferably comprises one or more hydraulic cylinders and a relative supply pump (the latter is not shown), but alternatively it can also comprise a pneumatic cylinder, a piezoelectric linear actuator, a solenoid electromagnet or other types of electric or electromagnetic linear actuators, a tilted plane mechanism; in any case such mechanisms are arranged for pressing the friction disks 50, 51 against one another with a pressure that can be regulated.

As shown in FIG. 3, the actuator 102 preferably comprises a single hydraulic cylinder with a tubular shape, and the shaft that is integral with the roll R1-R21 is fitted inside the internal cavity of the tubular cylinder, so as to distribute the axial pressures applied by the cylinder to the disks 50, 51 very homogeneously.

Advantageously, the torque regulator 100 comprises a control system that is arranged for controlling, for example in feedback, the torque regulator of at least one of the torque limiters 40, for example in order to vary with time the calibration torque of the torque limiter 40 or more in general the axial force with which the disks 50, 51 are pressed against each other. Such a control system comprises the logic unit 108 and, if it is a feedback system, a suitable sensor 110 is arranged for detecting a suitable variable in input, like for example the torque that the coupling head 14 applies to the external sleeve 43, or the difference between the rotation speed of the external sleeve 43 and the shaft 11 or 12 rotating integrally with the leveling rolls R1-R21 or again the differences in speed between the external surface of a roll R1-R21 and the treated metal sheet.

The logic unit can comprise for example an electronic microprocessor.

The sensor 110 can be a contactless torque sensor with a magnetostrictive effect, which offers different advantages, such as for example the possibility of detecting the resistant torque without contact and also operating in an oil bath or in relatively dirty environments.

Based upon the detections of the sensor 110 the logic unit 108 sends suitable control signals—for example electric, hydraulic, pneumatic or mechanical control signals—to the actuator 102, which varies the pressure with which it compresses the friction disks 50, 51 consequently varying the limit sliding torque of the torque limiter 40, or rather the maximum torque that the limiter can transmit; when the driving torque transmitted from the relative adapter shaft begins to exceed the limit sliding torque, the friction disks 50 begin to slide with respect to the disks 51 and the limiter 40 continues to drive the adapter shaft transmitting a torque that is equal or lower than the limit sliding torque to it, according for example to whether the static friction coefficient of the friction disks is respectively equal or greater than the dynamic friction coefficient.

As soon as the resistant torque, or in any case the torque transmitted by the adapter shaft 11, drops below the limit, the limiter 40 starts to entirely transmit it again to the rolls R1-R21 without sliding. The limit sliding torque increases as the force with which the actuator 102 presses the friction disks 50, 51 against one another increases.

The logic unit 108 can clearly implement various control algorithms, trying for example to keep the sliding torque of the disks 50, 51 constant with time and around a suitable objective value. In such a way the torque limiter 40 protects the transmissions when these are subjected to overloads, for example generated by excessive surface irregularities or thickness of the metal sheet to be leveled.

In another embodiment that is not shown, instead of a feedback control method, i.e. in a closed loop, the control system can implement a control method in an open loop.

Advantageously, the logic unit 108 is mounted on the frame 106 of the leveler 31, so as to not rotate integrally with any of the torque limiters 40; it is thus possible to mount on the frame 106 both the actuators 102 and the transmission lines that make it possible for there to be the exchange of control signals—for example hydraulic, pneumatic or electric lines—between the actuators 102 and the logic unit, considerably simplifying the mechanical making of the torque regulators 100, 100'.

In order to ensure an automatic lubricating of the limiter, in the area of the disks 50, 51, the external sleeve can be for example provided with inlet 53 and outlet 54 windows, for lubricant to pass through. Alternatively, the torque limiters 40 can be provided with an oil bath lubrication system, or of again other kinds.

Figure 5:
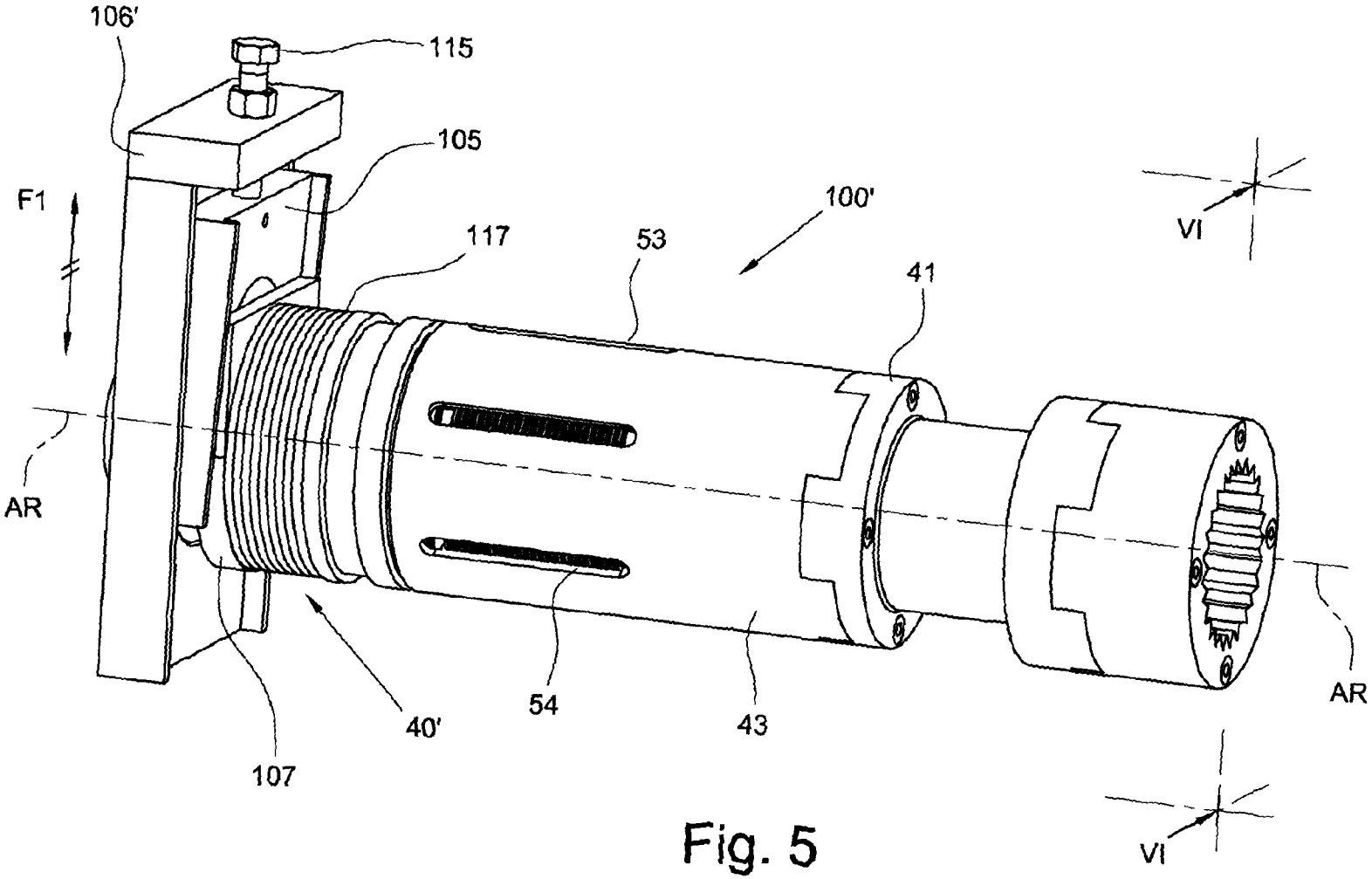
FIG. 5 shows a first perspective view of a torque limiter according to a second particular embodiment of the invention.
Figure 6:
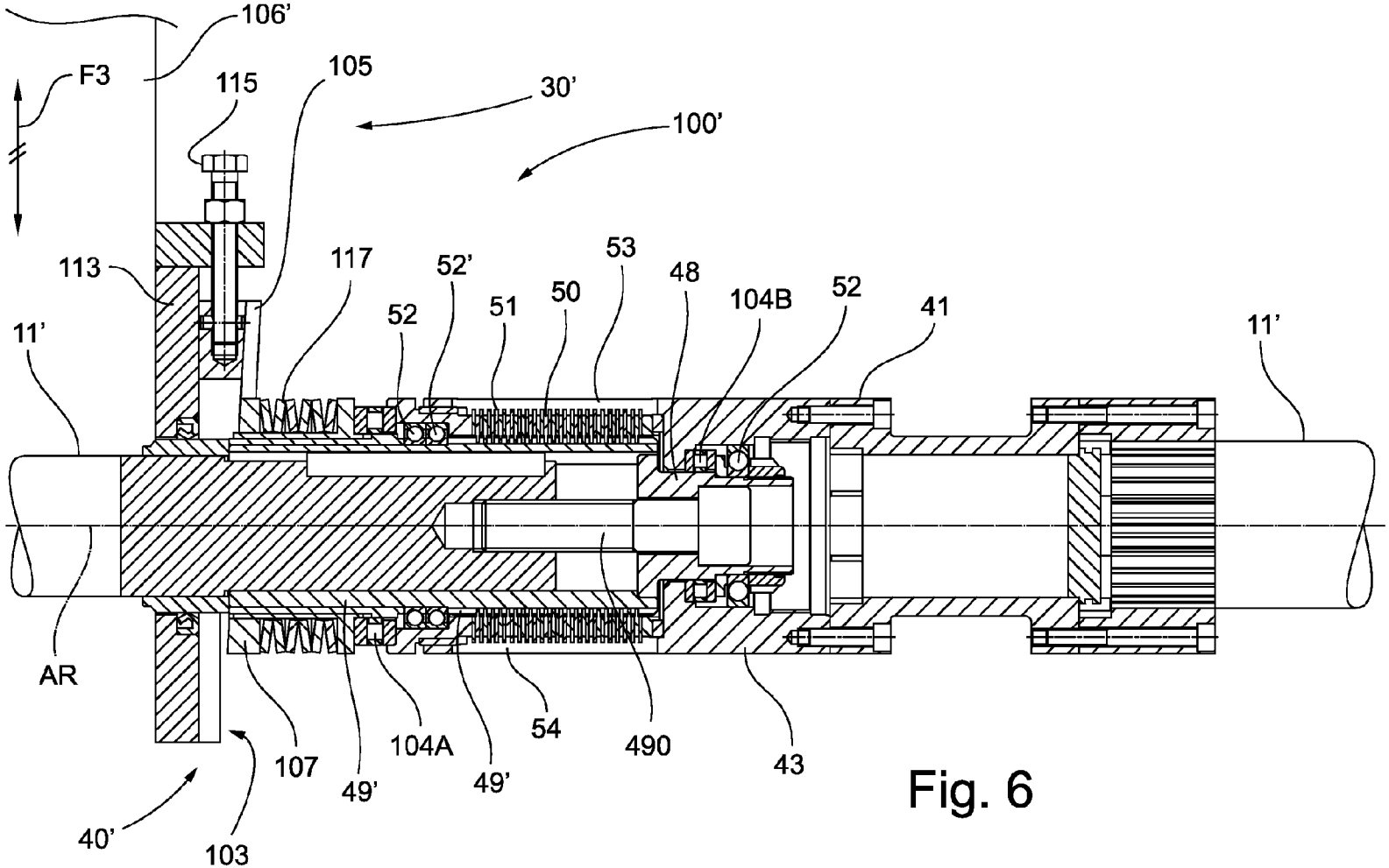
FIG. 6 shows a second perspective view, partially in section according to the section plane VI-VI, of the torque limiter of FIG. 6.
Figure 7:
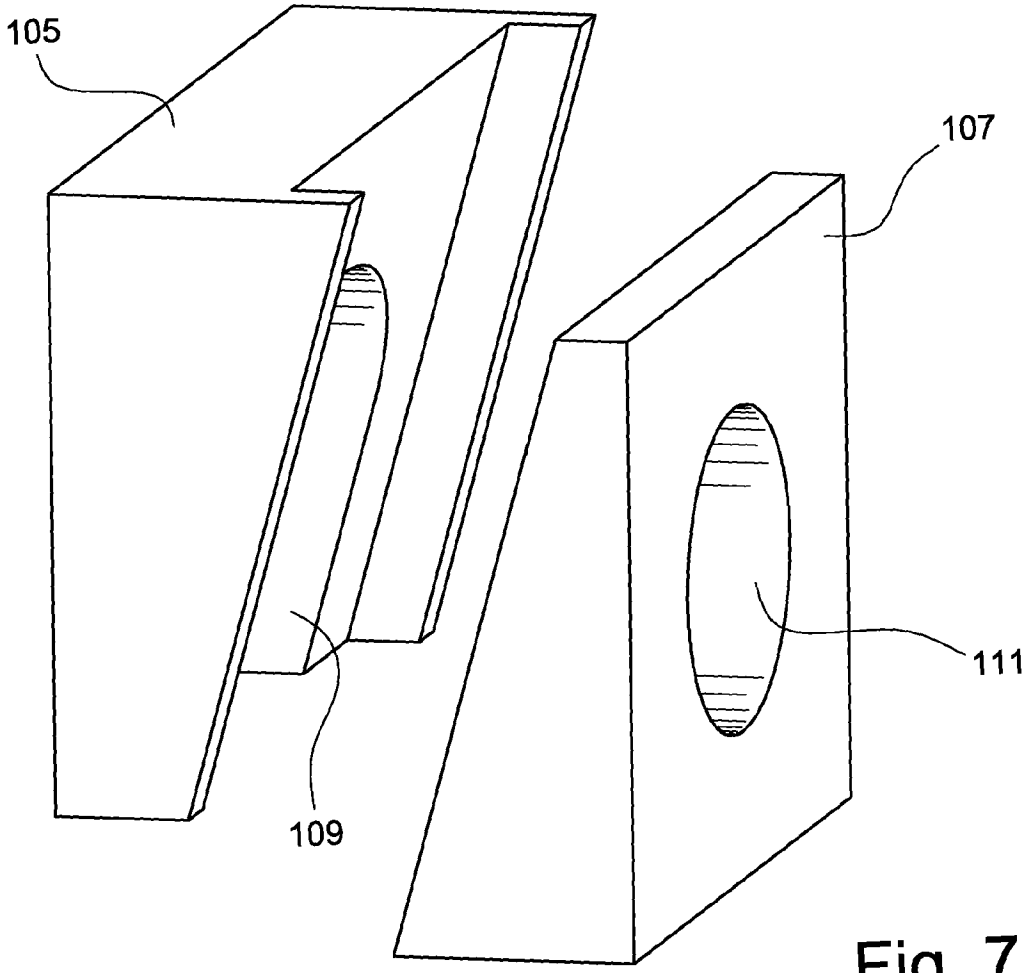
FIG. 7 shows an exploded perspective view of the tilted plane mechanism of the torque limiter of FIG. 6.

FIGS. 5-7 relate to a leveler, which is wholly indicated with reference numeral 30', according to a second embodiment of the invention.

The leveler 30' can differ from the leveler 30 previously described for the fact that its torque regulators 100' comprise a mechanism 103 with a tilted plane that is arranged for varying the predetermined limit torque, or rather the sliding torque of the torque limiters 40' to which the torque regulators 100' belong.

Preferably, the tilted plane mechanism 103 is arranged for varying the predetermined limit torque by varying the force with which the friction disks 50, 51 of the limiter 40' are pushed against each other at least in a direction that is parallel to the predetermined rotation axis AR. For such a purpose the mechanism 103 can comprise at least one first substantially wedge-shaped element 105 and possibly a second wedge-shaped element 107, which are arranged for sliding over one another perpendicularly or transversally (arrow F3) with respect to the rotation axis AR of the disks 50, 51.

Advantageously, the tilted plane mechanism 103, or at least its first 105 and its possible second wedge-shaped element 107 are fixed to the load-bearing frame 106' of the leveler 30' without rotating integrally with the rotating parts of the relative torque limiter 40' or with the portions of adapter shaft 11, 12 that drive or are driven by such a limiter 40'.

For such a purpose in the first 105 and in the possible second wedge-shaped element 107 respective pass-through openings 109, 111 are obtained through which the adapter shaft 11, 12, which drives or is driven by the limiter 40' in question passes, so as to pass through the wedge-shaped element 105, 107 preferably without touching them directly, thus allowing the sliding torque of the limiter 40' to be regulated while the leveler 30' operates and the adapter shafts 11, 12 are rotating. As shown in FIG. 6, the first wedge 105 can be fixed onto a suitable sliding guide 113 that is integral with the load-bearing frame 106' of the leveler and it can also operate as a sliding guide for the second wedge 107, so that by screwing or unscrewing the control screw 115—for example manually-, the first 105 and the second wedge 107 slide perpendicularly or transversally with respect to the adapter shaft segments 11, 12 (arrow F3) varying the axial compression force with which the friction disks 50, 51 are pressed against each other.

The second wedge 107 can be fixed to the splined shaft 49' on which the driving friction disks 50 are slidingly mounted. In particular, the wedge 107 can be mounted so as to press the pack of Belleville springs 117 mounted so as to be able to slide axially on the splined shaft 49' with a variable force. The Belleville springs 117 make it possible to regulate with greater precision the force with which the friction disks 50, 51 are pressed; when for pressing the friction disks 50, 51 sufficiently precise actuators are used, like for example the hydraulic actuator 102 of FIG. 3, the torque limiter may also be without Belleville springs 117.

Figure 8:
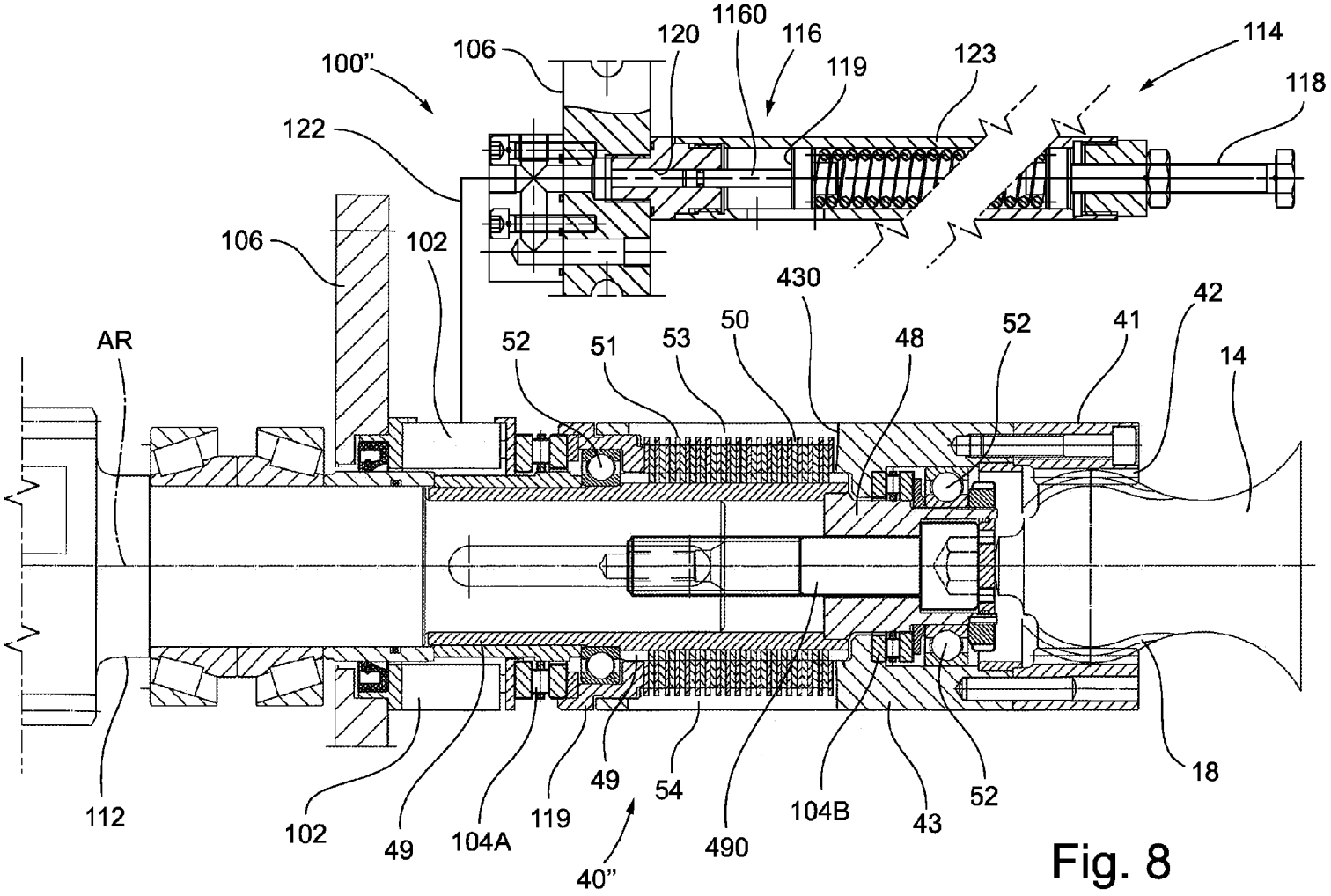
FIG. 8 shows a schematic view of a torque regulator according to a third particular embodiment of the invention.

FIG. 8 refers to a leveler, which is wholly indicated with reference numeral 30", according to a third embodiment of the invention. In the leveler 30" some or all of the torque regulators 100" are provided with a manual control unit 114 arranged to control one or more actuators 102. If the actuator 102 comprises a hydraulic cylinder, the control unit 114 can comprise a mechanical pressure regulator that is mounted externally with respect to the torque limiter 40" and is arranged for varying the oil pressure or other hydraulic liquid contained in the cylinder 102, so as to vary the force with which the friction disks 50, 51 are pressed against each other, consequently varying the sliding torque value of one or more limiters 40". The unit 114 comprises a piston device, in which the axial position of the piston 116 can be regulated by manually screwing or unscrewing the regulating screw 118. The piston 116 slides longitudinally in the chamber 120, regulating the pressure of the hydraulic oil contained in the duct 122 and in the chamber of the hydraulic cylinder 102; the latter is in fluidic communication with the duct 122.

Between the piston 116 and the screw 118 one or more springs 123 are advantageously interposed operating through compression—for example a spiral-shaped spring—and that make it possible to regulate the pressure of the hydraulic fluid in the chamber of the hydraulic cylinder 102 with greater precision. Possibly, the piston group 116 can comprise a stem 1160 and a head 119 that is fixed to the stem and against which the spring 123 rests. The end of the stem 1160 that slides in the chamber 120 preferably has a diameter that is much shorter than that of the head 119, so as to amplify the pressure generated by the spring 123.

Advantageously, the control unit 114 is mounted integrally with the load-bearing frame 106 of the leveler 31".

In view of an extremely simple and cost-effective mechanical embodiment, the torque regulator 100" and its control unit 114 make it possible to manually but very quickly regulate the sliding torques of the limiters 40", also while the leveler is operating. Advantageously, like in the embodiment of FIG. 8 each manual control unit 114 drives a single actuator 102 so as to be able to independently regulate each single sliding torque of the single limiters 40". A leveler provided with the control units 114 is moreover already arranged for being improved: indeed in order to provide it with a more advanced system for regulating the sliding torque it is sufficient to remove the chambers 120 and the relative pistons 116 from their seats on the frame 106, and connect the ducts 122 of the various limiters 40" for example with a suitable hydraulic power stage of the logic unit 108 previously described, so as to regulate the various sliding torques in a completely automatic manner; in such a case the logic unit 108 and/or its hydraulic power stage constitute a control unit that is not manual but automatic.

In one embodiment that is not shown, the hydraulic cylinder of each actuator 102 is replaced by an electric actuator, like for example a piezoelectric actuator, an electromagnet or a linear electric motor, and the manual hydraulic control unit 114 can be replaced with a manual voltage-, current- or electric power regulator, or with the logic unit 108 or a possible electric power stage thereof.

As already outlined in patent IT1355222, the leveler variants 31, 31', 31" previously described make it possible to carry out less maintenance operations over time, are less subject to breaking or deformations and they are capable of providing a production that has a higher quality and greater constancy over time; in general the levelers 31, 31', 31" offer all the advantages described in patent IT1355222. The levelers 31, 31', 31" moreover make it possible to vary the speed and precision that are much greater than the predetermined limit torque of the various torque limiters 40, in particular while the levelers are operating. In any case, regardless of whether they implement a feedback control method, or an open loop control method, since they do not require the manual regulation of a large number of threaded dowels, and consequently to demount the respective adapter shafts, the control system of the leveler 30 makes it possible to automatically vary,—in a practically instantaneous manner—the limit torques of the different pressure limiters much faster, even independently and differently from one another, as shall be described more in detail in the rest of the description as an example. On the other hand, manually regulating the dowels of a leveler according to patent IT1355222, which requires demounting the adapter shafts, usually requires at least a few hours.

By allowing the sliding torques to be adjusted while the leveler is operating and in real time, the torque limiters and the control system according to the invention make it possible to have an immediate indication, even visual, of the effects of the regulation, making it possible to optimise it with greater precision also in the case in which it is regulated manually; moreover making it possible to regulate the limit torques with strategies and modalities that are much more complex, such as for example those described in the Italian patent application filed by the Applicant with the same filing date as the present application, for example leveling the metal sheet not only with bending stress, but also with combined bending and traction stress. These advantages are even more important and appreciated considering that it is generally desirable to regulate a leveler based upon the characteristics of each metal sheet to be treated time by time. The torque limiters and the control system according to the invention also make it possible to improve the energy efficiency of a leveler and the surface quality of the treated metal sheet, reducing the aforementioned faceting of the leveling rolls, increasing the operational life of the rolls and in general eliminating or in any case considerably reducing the drawbacks caused by the aforementioned twisting vibrations.

Now we shall describe some examples of modalities for controlling and setting the limit torque of the torque limiters, wherein such sophisticated modalities are made possible or in any case easier to make with the levelers according to the invention previously described.

According to a first possible control criterion, the torque limiters 40 are advantageously calibrated or controlled—for example but not necessarily in real time with a feedback control—so as to be processed all in continuous sliding condition and so that all the leveling rolls are almost perfectly synchronised with the speed of the external fibres of the metal sheet with which they are in contact.

The leveler thus operates substantially like a differential gear of a motor vehicle that redistributes the driving torque between the various leveling rolls R1-R21 more correctly and homogeneously allowing each roll to rotate with its own speed independently from that of the other rolls; all the leveling rolls R1-R21 exert a driving action and none exert a resistant work.

This can be obtained for example by ensuring that the calibration torques of the various torque limiters are substantially the same as one another, except for suitable tolerances in excess or defect with respect to their mean value, and substantially equal to the average of the leveling torque that the various adapter shafts 11, 12 would normally transmit to the rolls R1-R21 during the leveling in absence of both the torque limiters 40 and of faults or jamming of the leveler. Such an average of the leveling torques can be for example but not necessarily an unweighted arithmetic mean.

The suitable tolerances of the calibration torques preferably equal to or lower than ±30% of their mean value.

More preferably the calibration torques of the various torque limiters are substantially equal to one another except for a tolerance equal to ±15% of their mean value, and even more preferably except for a tolerance equal to ±5% of their mean value.

Possibly, the average of the calibration torques of the various torque limiters 40 can vary within 0.8-1.2 times the average of the leveling torque that the various adapter shafts 11, 12 would normally transmit to the rolls R1-R21 during the leveling without torque limiters 40 and without faults or jamming of the leveler.

In a second possible control criterion, the calibration torque of at least one torque limiter 40 or 40' is equal to or lower than 1.5 times the minimum torque with a deformation work that is null, i.e. the minimum torque that the limiter 40 in question would have to transmit in order to make the relative leveling roll rotate if the work of deformation carried out by that roll on the metal sheet to be processed were null, and therefore for example if a band of metal sheet were to pass through the leveler 31 without being plastically deformed by the rolls and the torque limiter 40 or 40' were to mainly overcome only the rolling limiting friction and the resistance of the gaskets of the leveler.

In such a case, the torque limiter 40, 40' calibrated at the minimum torque with a deformation work that is null is preferably that which drives at least one from the following leveling rolls:

the roll further upstream R1;

the lower roll further upstream;

the two or three rolls further downstream R19-R21.

It has indeed been found that, due to the aforementioned interactions between the leveling rolls and the metal sheet, the roll further upstream R1, the lower roll further upstream and the two or three rolls further downstream R19-R21 almost always oppose the advancing movement of the metal sheet, generating a braking and resistant action on the distributing/reducing group 30.

More preferably, all the torque limiters 40 are calibrated with a calibration torque that is equal to or lower than 1.1-1.2 times the minimum torque with a deformation work that is null. This optimises the performance of the motorization of the machine, increases the durability of the leveling rolls thanks to the substantial elimination of the sliding between leveling rolls R1-R21 and the metal sheet L to be leveled and, for the same reason, improves the surface quality of the leveled metal sheet. Differently from the third embodiment however, the torque limiters 40 do not all operate in a continuous sliding condition.

In a third possible control criterion, the torque limiters 40 that actuate a suitable number of leveling rolls upstream—for example the first 2-5 rolls, i.e. the rolls R1 and R2, the rolls R1-R3, R1-R4 or again the rolls R1-R5—are calibrated with a very low calibration torque, for example indicatively equal to or lower than 0.3 times the average torque Cm of the various torque limiters 40. For the sake of clarity the average calibration torque Cm can be for example the arithmetic mean of the various calibration torques Ci of all the torque limiters 40 that are associated with all the rolls R1-R21, and can be calculated for example with the following formula $$Cm=\Sigma i=1 \ldots 21\ Ci/N$$

where N is the overall number of rolls R1-R21.

More preferably the torque limiters 40 that actuate a suitable number of leveling rolls upstream are calibrated with a calibration torque that is equal to or lower than 0.1 times the average torque Cm of the various torque limiters 40.

With this last calibration criterion the calibration torque of a certain number of torque limiters upstream can be compared to a torque that is null or almost null with respect to the resistant torque applied to the other rolls. The null or almost null values of the calibration torque make the relative leveling rolls upstream almost idle and ensure that the remaining rolls downstream thereof also carry out the leveling work of the idle rolls in inlet pulling the metal band. The idle rolls generate by themselves a very considerable resistant force, therefore it is not necessary to apply resistant torques to them for example by means of the relative adapter shafts 11, 12. This means that in any case there is a combined bending and traction stress of the metal sheet to be processed L, differently from only the bending stress that can be obtained with conventional leveling processes, with the consequent advantage of an improved quality efficiency and performance of the leveling process.

The calibration or control criteria described above make it possible to distribute more evenly the mechanical stresses between the various leveling rolls and the relative adapter shafts or in general transmission and actuation systems, as well as to reduce the sliding between rolls and metal sheet with respect to the levelers and to the leveling processes of the prior art. This makes it possible to improve the energy efficiency of a leveler and the surface quality of the treated metal sheet, as well as to level the metal sheet not only with bending stress, but also with combined bending and traction stress.

The embodiments previously described can undergo numerous modifications and variants without for this reason departing from the scope of protection of the present invention. For example, the torque limiters 40, 40' can be mounted not only between the distributing/reducing group 30 and the relative adapter shaft, but for example also in an intermediate point of the adapter shaft or between the adapter shaft and the leveling roll driven by it. The adapter shafts 11, 12 may also not be telescopic and can be replaced with other types of drive shafts. The actuator 102 may comprise not only a hydraulic cylinder with a tubular piston, but also a plurality of hydraulic cylinders with a chamber that is not annular or tubular and that are positioned as a crown around the shaft integral with the roll R1-R21. The Belleville springs 117 can be replaced with other elastic elements. The first 105 and the second wedge element 107 can be replaced by other components that are suitable for making mechanisms with a tilted plane, for example by male components and corresponding conical, conical frustum, pyramidal o pyramidal frustum female seats, or by male/female threaded couplings. Instead of manually, the screw 115 can be actuated or replaced by a suitable actuator, for example by a rotary or linear motor, or again by an electromagnet.

In general all the details can be replaced by technically equivalent elements. For example the materials used, as well as the sizes, can be any according to the technical requirements. The examples and lists of possible variants of the present application should be considered as non exhaustive lists.

The invention claimed is:

1. A roll leveller for metal sheets, comprising:

a plurality of levelling rolls substantially parallel to each other and positioned so as to substantially form two layers facing and opposite each other so as to allow a metal sheet to be processed, to pass between the two layers of levelling rolls following an undulating route;

a plurality of adapter shafts;

a plurality of torque limiters;

and wherein:

each adapter shaft is reversibly connected to at least one of the levelling rolls and reversibly connected to one of the torque limiters so as to drive the at least one of the levelling rolls or the torque limiter or so as to be driven by the at least one of the levelling rolls or the torque limiter;

each of the torque limiters comprises a friction disks coupling and two ends of a shaft connected to said coupling, which, in turn, comprises a plurality of friction disks adapted to rotate on themselves around a predetermined rotation axis (AR) and being pressed against each other at least in a direction parallel to the predetermined rotation axis (AR);

each of the torque limiters is adapted to keep the friction disks substantially integral with each other when the two shaft ends apply to the friction disks coupling a torque lower than the calibration torque of the limiter;

each of the torque limiters is adapted to allow each of its friction disks to slide with respect to each other, maintaining a maximum driving torque transmitted by an adapter shaft of the plurality of adapter shafts relating to the torque limiter in question, below a predetermined limit torque when the two shaft ends apply to the torque limiter a torque at least equal to the calibration torque of the limiter, so as to limit, to the predetermined limit torque, the maximum driving torque that each adapter shaft can transmit to a respective levelling roll reversibly connected to each adapter shaft and thereby driving the respective levelling roll;

each of the torque limiters being provided with a torque regulator having an actuator adapted to vary the predetermined limit torque also when the leveller is levelling the metal sheet to be processed and is controlled by electric, hydraulic, pneumatic or mechanical control signals; and each of the torque limiters is adapted to actuate the respective levelling roll also after reaching the predetermined limit torque.

2. The leveller according to claim 1, wherein the actuator of each of the torque limiters is adapted to press the friction disks against each other with a variable pressure at least with time, at least according to a direction parallel to the predetermined rotation axis (AR) of the plurality of friction disks.

3. The leveller according to claim 1, wherein the actuator of each of the torque limiters comprises one or more of the following devices: a hydraulic cylinder, a pneumatic cylinder, a piezoelectric linear actuator, an electromagnet or other linear electric, electromagnetic or electromechanical actuator, or a mechanism with a tilted plane and these devices are adapted to press the friction disks against each other with a variable pressure.

4. The leveller according to claim 3, wherein the tilted plane mechanism of each of the torque regulators is adapted to vary the predetermined limit torque by varying the force with which the friction disks are pushed against each other, at least in a direction parallel to the predetermined rotation axis.

5. The leveller according to claim 3, wherein the tilted plane mechanism of each of the torque regulators comprises at least one substantially wedge-shaped element, or a pyramid-shaped, conical, conical- or pyramidal frustum shaped element.

6. The leveller according to claim 5, wherein:

the at least one substantially wedge-shaped element is adapted with a one pass-through opening thereby allowing the relative adapter shaft to pass through the at least one substantially wedge-shaped element.

7. The leveller according to claim 1, wherein the torque regulator of each of the torque limiters comprises a tilted plane mechanism adapted to vary the predetermined limit torque.

8. The leveller according to claim 1, comprising a control system adapted to control, with or without feedback loops, the torque regulator of at least one torque limiter.

9. The leveller according to claim 8, wherein the control system is adapted to feedback control the torque regulator of at least one of the torque limiters, and comprises a logic unit.

10. The leveller according to claim 9, wherein the control system comprises a torque sensor.

11. The leveller according to claim 10, wherein the torque sensor is a magnetostrictive torque sensor.

12. The leveller according to claim 1, comprising a control unit positioned externally with respect to an at least one of the torque limiters and is adapted to control the actuator of such a limiter.

13. The leveller according to claim 12, wherein:

the actuator of the at least one of the torque regulators is a hydraulic actuator;

the control unit is a manual control unit comprising a mechanical pressure regulator adapted to manually regulate the pressure of the oil or of the other hydraulic fluid that drives the actuator.

14. The leveller according to claim 13, wherein the mechanical pressure regulator comprises a chamber adapted to contain oil or another hydraulic fluid, a piston able to slide in the chamber so as to expel from it or draw in it oil or another hydraulic fluid and actuate the actuator of the at least one of the torque limiters, and a screw or another threaded regulating rod adapted to actuate the piston.

15. The leveller according to claim 12, wherein the control unit is adapted for being actuated by hand.

16. The leveller according to claim 1, comprising a load-bearing frame on which the plurality of levelling rolls is mounted, and wherein the actuator of each of the torque regulators:

is mounted on the load-bearing frame so as to not rotate integrally with any of the torque limiters; and is adapted to press against the friction disks through an axial bearing that allows the mutual free rotation between the actuator and the friction disks with respect to the predetermined rotation axis.

* * * * *